United States Patent [19]

Ballagh

[11] 3,975,051

[45] Aug. 17, 1976

[54] ORTHOPEDIC CHAIR

[76] Inventor: Robert V. Ballagh, 370 Santa Ana Ave., Long Beach, Calif. 90803

[22] Filed: Mar. 8, 1976

[21] Appl. No.: 664,819

[52] U.S. Cl. ..... 297/434; 297/433; 297/435

[51] Int. Cl.[2] ..... A47C 7/50

[58] Field of Search ..... 297/433–436

[56] References Cited

UNITED STATES PATENTS

| | | | |
|---|---|---|---|
| 206,379 | 7/1878 | Wilson | 297/434 |
| 2,679,283 | 5/1954 | Mahone | 297/434 X |
| 3,794,381 | 2/1974 | Caldemeyer | 297/435 |

*Primary Examiner*—James C. Mitchell

*Attorney, Agent, or Firm*—William C. Babcock

[57] ABSTRACT

An orthopedic chair particularly adapted for the use of an invalid or patient suffering from disabling diseases such as arthritis, sciatica, or the like. The orthopedic chair includes a movably supported frame assembly that serves to maintain a forwardly and downwardly extending saddle-shaped seat at a desired elevation between a pair of laterally spaced side walls and a back rest. The frame movably supports a pair of laterally spaced channels for longitudinal movement relative to the seat, with the forward extremities of the channels having first and second leg supports pivotally mounted thereon. The frame assembly supports first and second reversible electric motors that drive first and second mechanisms that pivot the first and second leg supports to desired angular positions relative to the first and second channels. First and second electric switch mechanisms are mounted at convenient locations on the first and second side walls to permit the user of the invention to selectively energize either the first and second members jointly or individually to pivot the first and second leg supports to desired angular positions. Due to the configuration of the saddle-shaped seat, the user in the orthopedic chair is at all tims urged into a position where his feet are maintained in contact with foot rests that form a part of the leg supports. The orthopedic chair preferably has a source of electricity, such as a battery, removably mounted thereon in a concealed position.

3 Claims, 5 Drawing Figures

FIG. 1
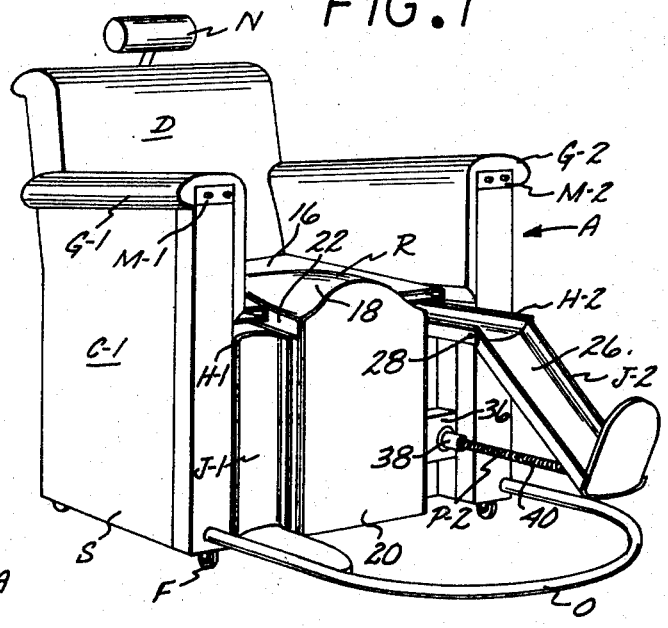
FIG. 2
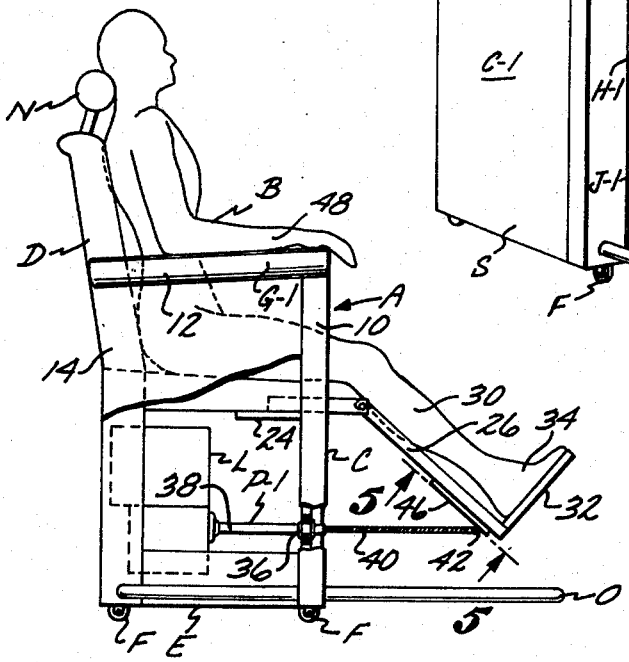
FIG. 5
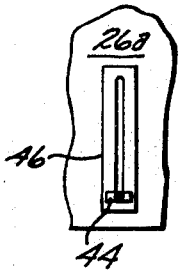
FIG. 4
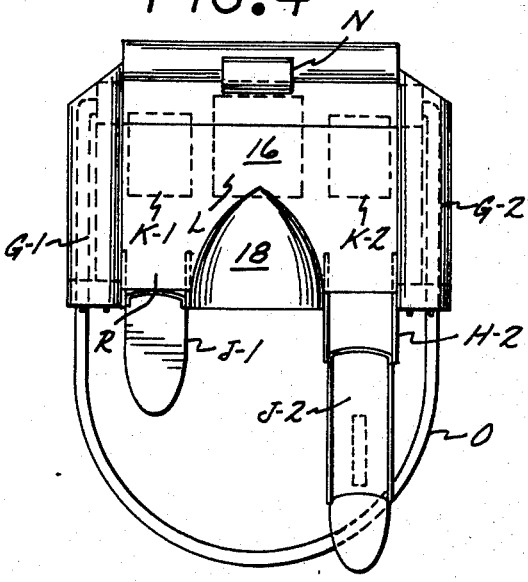
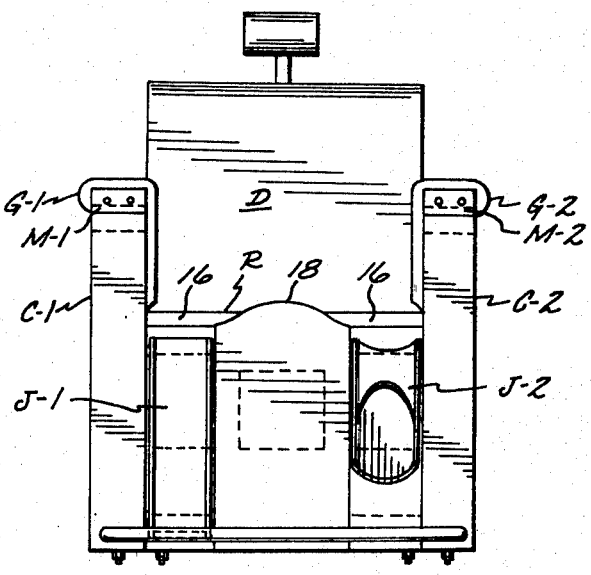
FIG. 3

ORTHOPEDIC CHAIR

BACKGROUND OF THE INVENTION

1. Field of the Invention

Orthopedic chair.

2. Description of the Prior Art

In the past, numerous chairs and beds have been devised and used, that are particularly adapted for patients or invalids. However, such devices are not well adapted for self-manipulation by patients or invalids suffering from disabling diseases such as arthritis, that limit the movement of the patient or invalid's hands in actuating the adjustable features of the chairs or beds.

A major object of the present invention is to provide an orthopedic chair that is particularly adapted for use by a person suffering from a disabling disease such as arthritis, or the like, and one that is poweroperated and permits the patient or invalid using the same to adjust the leg supports that form a part thereof to a desired angular position either in unison or individually, with this adjustment being effected by the patient or invalid with a minimum of movement of his arms and hands during the adjusting process.

Another object of the invention is to provide an orthopedic chair that is of simple mechanical structure, is simple and easy to use, may be moved from place to place without danger of the foot supports inadvertently contacting a wall structure, and the user being maintained in a desired upright sitting position in the chair due to the cooperation between the adjustable foot support and the novel shape saddle-type seat that forms a part of the chair.

SUMMARY OF THE INVENTION

An orthopedic chair for use by an individual that is suffering from a disabling disease such as arthritis, or the like, which chair includes a frame assembly that is defined by laterally spaced first and second side walls that support first and second arm rests, a back rest, and a base on which the side walls and back rests are mounted. The base is movably supported on casters, and as a result the orthopedic chair may be easily moved from place to place on a floor surface. A saddle-shaped seat that extends downwardly and forwardly is supported at an elevated position on the frame assembly and is connected to the back rest and pair of side walls. First and second parallel laterally spaced channels are slidably supported for longitudinal movement on the frame assembly, and are situated beneath the saddle-shaped seat. The forward extremities of the first and second channels have first and second leg supports pivotally suspended therefrom, and the leg supports adapted to have the calf portions of the user's legs and his feet rest thereon.

First and second reversible electric motors are mounted in concealed positions within the frame assembly and are preferably actuated by an electric battery also mounted on the frame assembly. The first and second motors when actuated by first and second assemblies drive first and second mechanisms that permit the first and second leg supports to be pivoted angularly relative to the supporting channels. Actuation of the first and second motors to rotate in either a forward or reverse direction is controlled by first and second manually operated switch assemblies that are preferably mounted on the forward extremities of the arm rests or side walls to permit these switch assemblies to be manipulated by the patient or invalid in the orthopedic chair with minimum movement being required by him in such manipulation.

BRIEF DESCRIPTION OF THE DRAWING

FIG. 1 is a perspective view of the orthopedic chair, with one of the channels and pivotally supported leg supports illustrated in a forwardly extending position and the other of the leg supports in a concealed position;

FIG. 2 is a side elevational view of the orthopedic chair illustrating the manner in which the leg supports cooperate with the saddle-shaped seat to maintain the patient or invalid using the chair in a sitting position;

FIG. 3 is a front elevational view of the chair;

FIG. 4 is a top plan view of the chair; and

FIG. 5 is a fragmentary elevational view of a slide assembly that is secured to one of the leg supports, and the view taken on the line 5—5 of FIG. 2.

DESCRIPTION OF THE PREFERRED EMBODIMENT

The orthopedic chair A shown in the drawing, is particularly adapted for the use of a patient B suffering from arthritis or other disabling disease. The chair A includes a frame assembly C. The frame assembly C comprises first and second laterally spaced side walls C-1 and C-2, and a back rest D.

The first and second side walls C-1 and C-2, together with back rest D, are mounted on a base E that is movably supported by a number of spaced casters F.

First and second arm rests G-1 and G-2 are mounted on the first and second side walls C-1 and C-2. First and second parallel, laterally spaced rigid channels H-1 and H-2 are slidably supported by frame assembly C under a saddle-shaped seat R that is connected to the first and second side walls C-1 and C-2. The first and second channels are longitudinally movable by the patient, and are situated under the seat R as best seen in FIG. 2. The seat R as may be seen in the drawings, has an upper surface that slopes downwardly and forwardly.

First and second leg supports J-1 and J-2 are pivotally supported from the forward extremities of the first and second channels H-1 and H-2.

Frame assembly C supports first and second reversible electric motors K-1 and K-2 that may be independently or jointly energized from a source of electric power, preferably a battery L supported from the frame assembly C. Control of the first and second motors K-1 and K-2 is by first and second manually operated switch assemblies M-1 and and M-2 that are mounted on the forward extremities of the arm rests G-1 and G-2.

The back rest D supports a head rest N for use by the patient B. The frame assembly C supports a U-shaped forwardly extending bumper 0 to prevent the first and second leg supports J-1 and J-2 inadvertently contacting a wall (not shown) or the like when the chair is being moved from place to place. The first and second electric motors K-1 and K-2 when energized actuate first and second mechanisms P-1 and P-2 to pivot the first and second leg supports J-1 and J-2 to desired angular positions relative to the first and second channels H-1 and H-2.

The first and second side walls C-1 and C-2 are of identical construction, and each includes a forwardly disposed upright 10 that has a lower portion secured to the base E. Each upright 10 has a forwardly and upwardly extending member 12 secured to the top thereof, with the rearward portion of each member 12 secured to a rearwardly disposed upright 14 that forms a part of the back rest D. The first and second side walls C-1 and C-2 and back rest D are covered with sheet upholstering material S. The base E is of conventional design, and may be fabricated from any rigid material to which the casters F may be secured.

The seat R has a U-shaped upper surface 16 that slopes downwardly and forwardly, and a central portion 18 within the confines of the U-shaped portion that is generally triangular in shape and slopes upwardly and forwardly. The two surfaces 16 and 18 cooperate to impart the saddle-shaped configuration to the seat R as may be seen in FIGS. 1 and 4. The seat R includes a forwardly disposed wall 20 that is vertically disposed, and from which the vertically disposed side members 22 extend rearwardly. The first and second channels H-1 and H-2 that are identical in structure, are supported in elongate guides 24 of conventional design that are situated between the first and second side walls C-1 and C-2 and the side members 22 that form a part of the seat R. The first and second channels H-1 and H-2 are manually adjustable by the user B when disposed in the orthopedic chair A. The first and second leg supports J-1 and J-2 are also of identical construction, and each of the leg supports includes an elongate channel-shaped member 26 that by pins 28 is pivotally supported from the forward extremities of the first and second channels H-1 or H-2 most adjacent thereto. The channel shaped member 26 of each of the leg supports J-1 and J-2 serves as a support for the calf portion 30 of the patient B when the latter is disposed in a sitting position in the orthopedic chair A as illustrated in FIG. 2. Each channel 26 on the forward extremity thereof supports an upwardly projecting foot rest 32 against which the foot 34 of the patient B abuts. Each of the uprights 10 support a bearing 36 that rotatably supports the forward portion of a tubular member 38 that is driven by one of the electric motors K-1 or K-2. The mechanisms P-1 and P-2 are identical in construction, and each includes one of the tubular members 38 supported in a bearing 36. The forward portion of each tubular member 38 has internal threads (not shown) formed therein, which threads rotatably engage a threaded rod 40, one of which rods is shown in an extended position in FIG. 1. Each rod 40 on the forward end thereof is pivotally connected at 42 to an elongate slide 44 that is longitudinally movable in a slotted guide 46 secured to the rearward surface 26*a* of a channel 26. As one of the electric motors K-1 or K-2 is electrically energized, the tubular member 38 associated therewith is rotated, and rotates relative to the threaded rod 40 associated therewith. As the tubular member 38 so rotates, the threaded rod 40 moves either forwardly or rearwardly relative to the frame assembly C, dependent upon the direction of rotation of the motor K-1 or K-2. As the threaded rod 40 so rotates, the first or second leg support J-1 or J-2 associated therewith, is pivoted upwardly or downwardly to a desired position that is most comfortable for the calf portion 30 and foot 34 of the patient B. As such pivotal movement of the first or second leg support J-1 or J-2 takes place, the slide 44 moves longitudinally within the guide 46, to maintain the threaded rod 40 associated therewith, in a horizontal position. Energization of the electric motors K-1 and K-2 is accomplished by the patient B manipulating the first or second switch assembly M-1 or M-2, and without being required to move his arms 48 to any substantial degree to accomplish this result. The electric circuit that controls energization of the electric motors K-1 and K-2 by use of the first and second switch assemblies M-1 and M-2 is conventional, and accordingly this circuit is not shown in detail. The circuit includes conventional stop switches (not shown) to prevent the tubular members 38 rotating to the extent that the threaded rods 40 will be displaced therefrom or moved inwardly relative to the tubular members 38 after the first and second leg supports J-1 and J-2 have been disposed in vertically aligned positions relative to the frame assembly C, such as occupied by the first leg support J-1 illustrated in FIG. 1. The surfaces 16 and 18 of the seat R cooperate to tend to move the portions of the patient B resting thereon into a forwardly extending position, to maintain the feet 34 of the patient in abutting contact with the foot rest 32, and the calf portions 30 of the patient's feet in supported positions on the channels 26. The head rest N is of conventional or contoured design and may be adjusted to a desired position to engage the rearward portions of the patient B, which will normally be either the neck or head portion of the patient.

The U-shaped bumper serves not only the purpose previously described but also as a mounting for a clamp-on braced traction bar of conventional design when the latter is required or found necessary for the comfort and treatment of the patient.

The use and operation of the invention has been described previously in detail and need not be repeated.

I claim:

1. An orthopedic chair for a user suffering from arthritis or like disease that includes:

a. a chair frame that includes a pair of laterally spaced walls that support a pair of arm rests, a back rest that extends between said walls, a saddle-shaped seat disposed forwardly of said back rest and that extends between said side walls, said walls, back rest and seat cooperating to define a confined space, said confined space being in communication with first and second laterally spaced passages that extend forwardly therefrom and are located below said seat;

b. first and second parallel, laterally spaced channels movably disposed in said first and second passages adjacent said seat, said first and second channels each having a first forwardly disposed end;

c. first means slidably supporting said first and second channels from said frame;

d. first and second L-shaped leg supports pivotally secured to said first ends of said channels and longitudinally aligned with said first and second passages;

e. first and second reversible electric motors disposed in fixed positions in said confined space;

f. first and second tubular members that may be driven by said first and second electric motors, said tubular members disposed in said first and second passages, said first and second tubular members having first and second internal threads on at least the forward portions thereof;

g. first and second bearings secured to said frame that rotatably support said tubular members;

h. first and second externally threaded rods that engage said first and second internal threads in said first and second tubular members, said first and second rods having forwardly disposed ends;

i. first and second hollow guides secured to said first and second leg supports and disposed longitudinally thereto;

j. first and second slides movable in said first and second guides, said forward ends of said first and second rods pivotally connected to said first and second slides;

k. a source of electric power;

l. an electric circuit for supplying electric power from said source to said first and second electric motors; and m. manually operable electric switch means adjacent said arm rests for selectively completing said circuit to either of said electric motors to cause the latter to rotate in either a first or second direction, said first or second electric motors when rotating in a first direction moving said first or second rod rearwardly to pivot said first or second leg support downwardly, said first or second electric motors when rotating in a second direction moving said first or second rods forwardly to pivot said first or second leg support upwardly, said first and second leg supports when such pivotal movement takes place supporting the portions of the user's legs beneath the knees, and said seat and first and second channels the portions of said users legs above the knees.

2. An orthopedic chair as defined in claim 1 which in addition includes:

h. a plurality of casters disposed below said frame and secured thereto to permit said chair to be moved on a floor surface.

3. An orthopedic chair as defined in claim 2 which in addition includes:

q. a U-shaped bumper secured to said walls and extending forwardly from said frame a sufficient distance as to prevent said first and second leg supports contacting a portion of a building structure, as well as serving as a mounting for a clamp-on braced traction bar of conventional design.

* * * * *